US005082267A

United States Patent [19]

Sanborn, III

[11] Patent Number: 5,082,267

[45] Date of Patent: Jan. 21, 1992

[54] AUTOMATIC FEEDER FOR WORKPIECES OF LIMP MATERIAL

[75] Inventor: Charles H. Sanborn, III, Shelbyville, Tenn.

[73] Assignee: Ark, Inc., Shelbyville, Tenn.

[21] Appl. No.: 445,539

[22] Filed: Dec. 4, 1989

[51] Int. Cl.[5] ..... B65H 3/00; B65H 5/02

[52] U.S. Cl. ..... 271/10; 271/162; 271/167; 271/275; 198/779

[58] Field of Search ..... 271/6, 10, 11, 12, 34, 271/147, 157, 162, 167, 198, 275 E, 277; 198/779; 112/121.15, 304

[56] References Cited

U.S. PATENT DOCUMENTS

| | | | |
|---|---|---|---|
| 3,670,674 | 6/1972 | Conner, Jr. | 112/121.29 |
| 3,768,807 | 10/1973 | Spengler | 271/5 |
| 4,157,823 | 6/1979 | Morton | 271/10 |
| 4,202,441 | 5/1980 | Bourgeois | 198/779 |
| 4,579,329 | 4/1986 | Frost et al. | 271/10 |
| 4,881,479 | 11/1989 | Freermann | 271/10 |

FOREIGN PATENT DOCUMENTS

| | | | |
|---|---|---|---|
| 203802 | 12/1986 | European Pat. Off. | 271/10 |
| 1948246 | 3/1971 | Fed. Rep. of Germany | 198/779 |
| 2538240 | 3/1977 | Fed. Rep. of Germany | 271/10 |
| 706552 | 3/1931 | France | 271/12 |
| 36247 | 2/1985 | Japan | 271/10 |

*Primary Examiner*—Robert P. Olszewski
*Assistant Examiner*—Steven M. Reiss
*Attorney, Agent, or Firm*—Senniger, Powers Leavitt & Roedel

[57] ABSTRACT

Apparatus for automatically feeding workpieces of limp material one at a time and one after another from a stack thereof to a device for operating thereon, e.g. for feeding plies of fabric from a stack of plies to sewing apparatus, comprising an endless conveyor having spaced flights and gaps. The stack of workpieces is held under an upper reach of the conveyor. A pick-up is operable through the gaps to grasp the top workpiece of the stack and pick it up with the workpiece extending down into the gap for engagement of the bottom surface of the workpiece by the oncoming flight of the conveyor to complete the separation of the workpiece from the stack and to bring it to lie generally flat on the oncoming flight.

Figure 1:
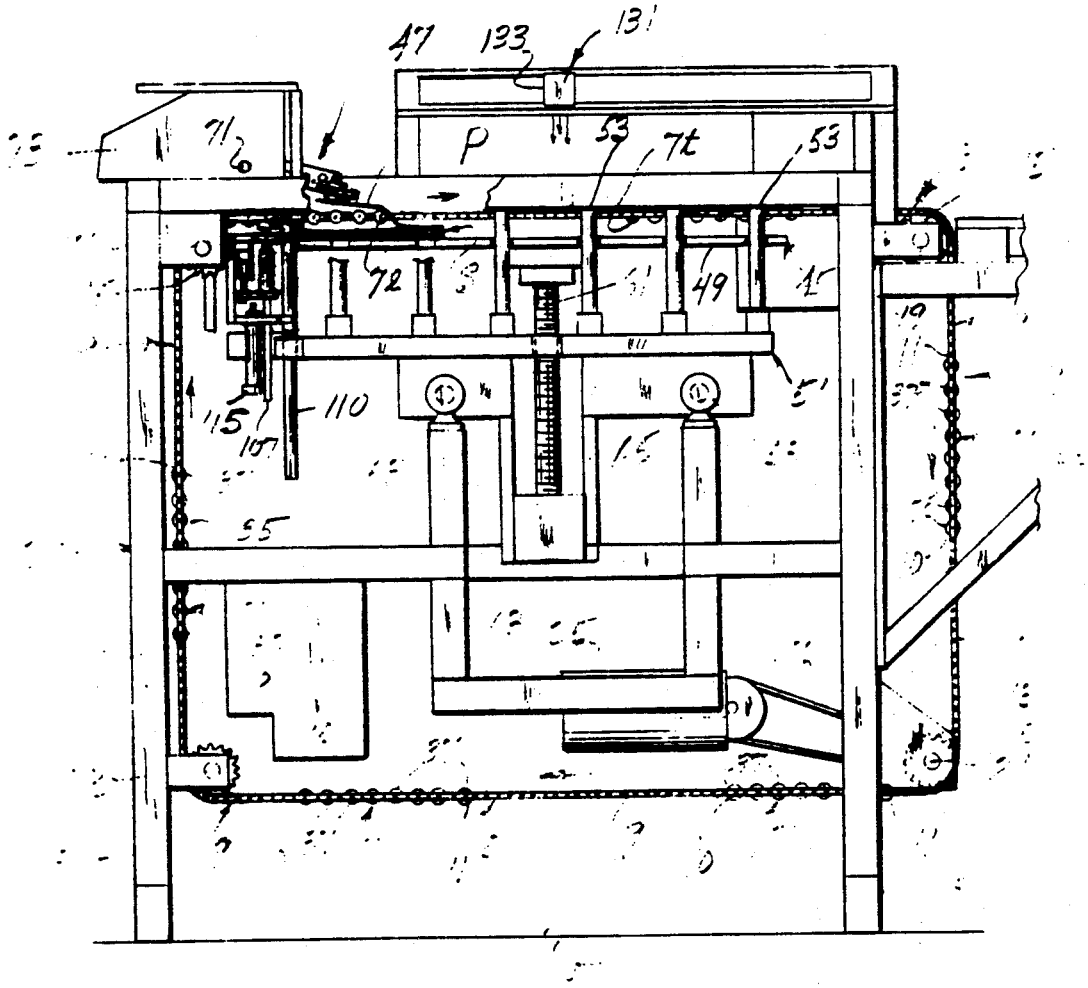
Figure 2:
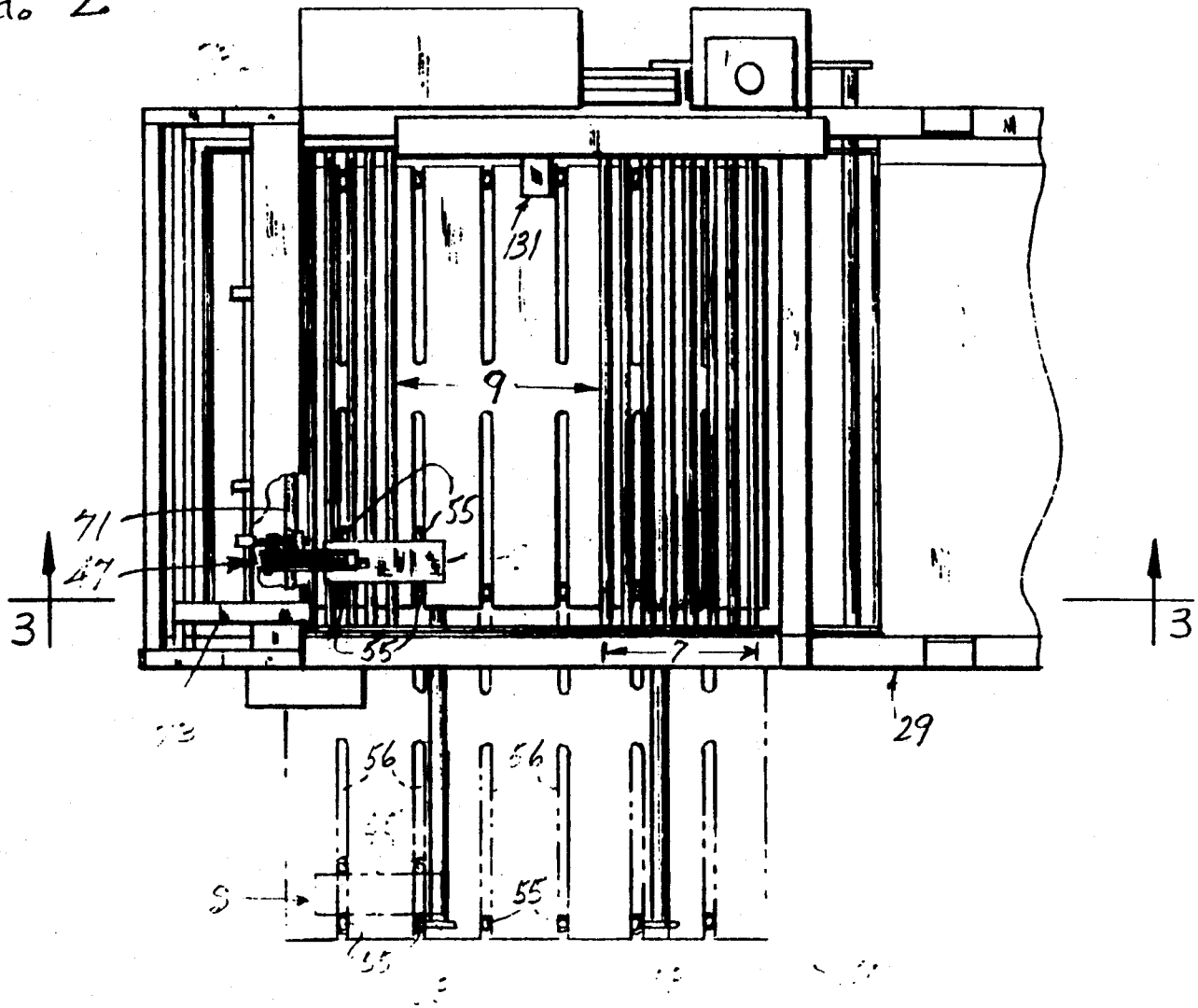
Figure 3:
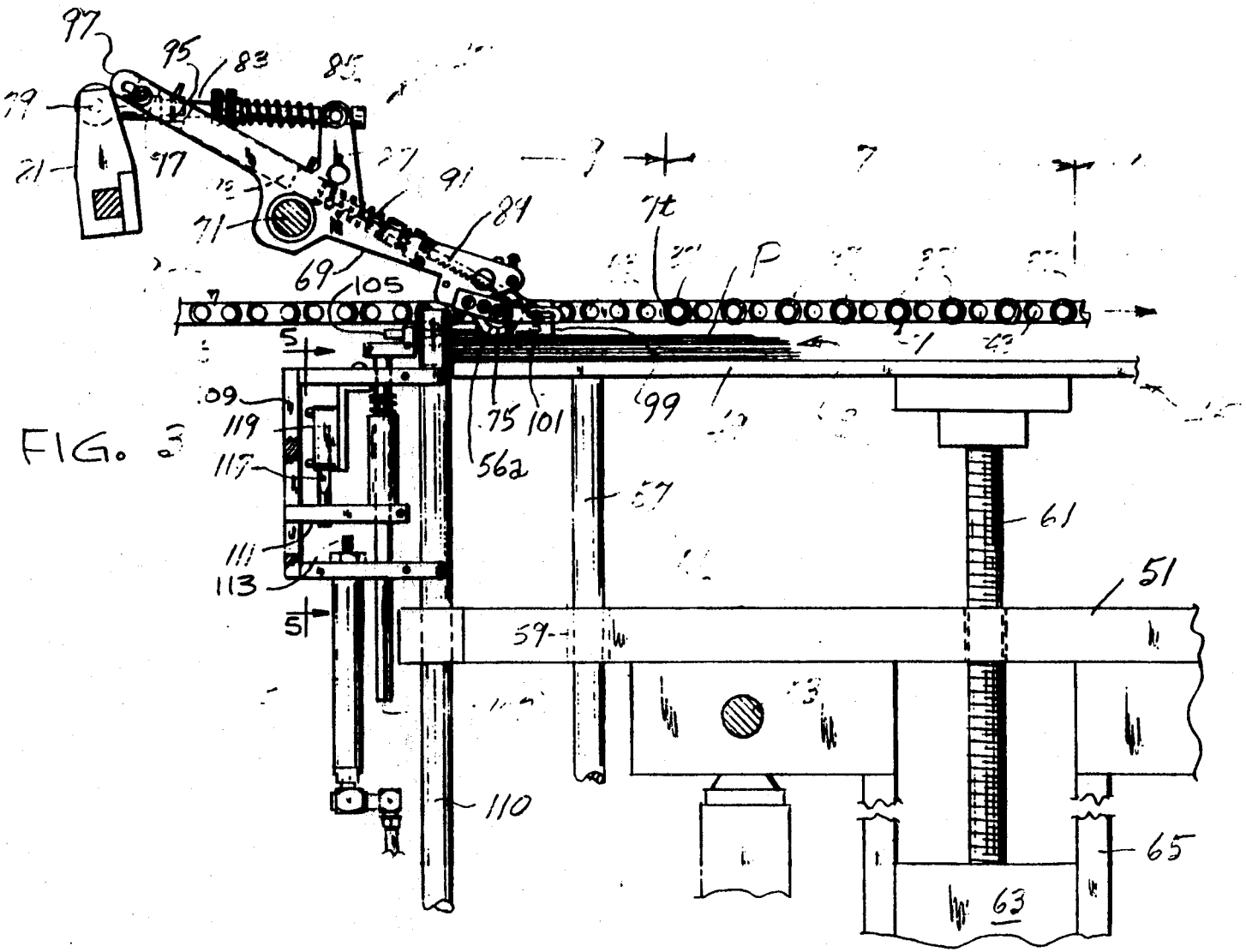
Figure 4:
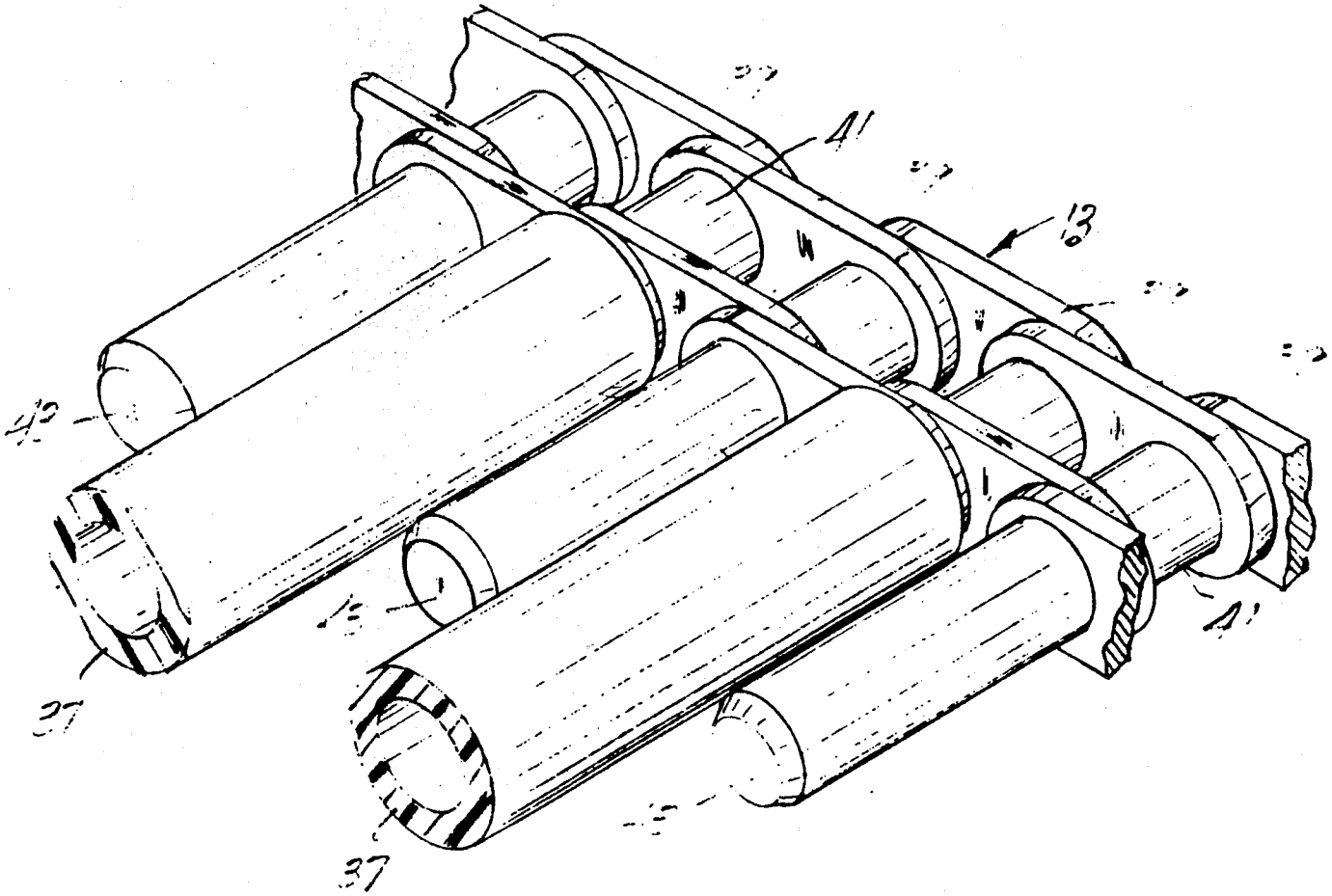
Figure 5:
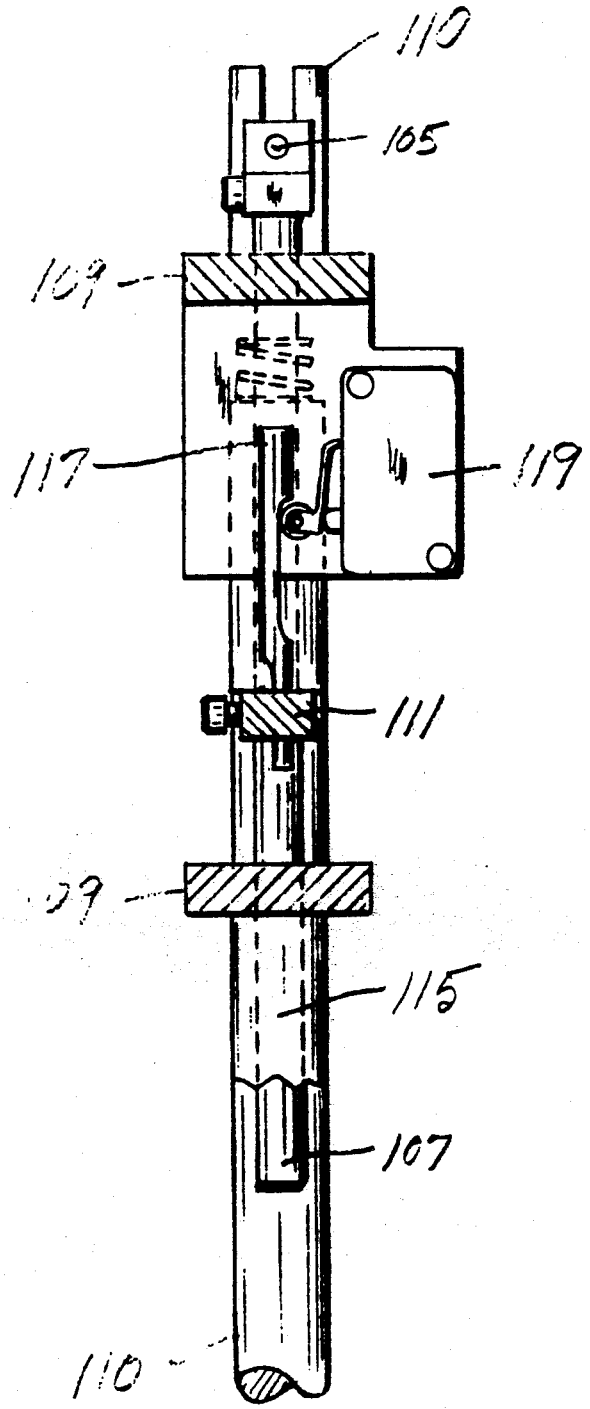
Figure 6:
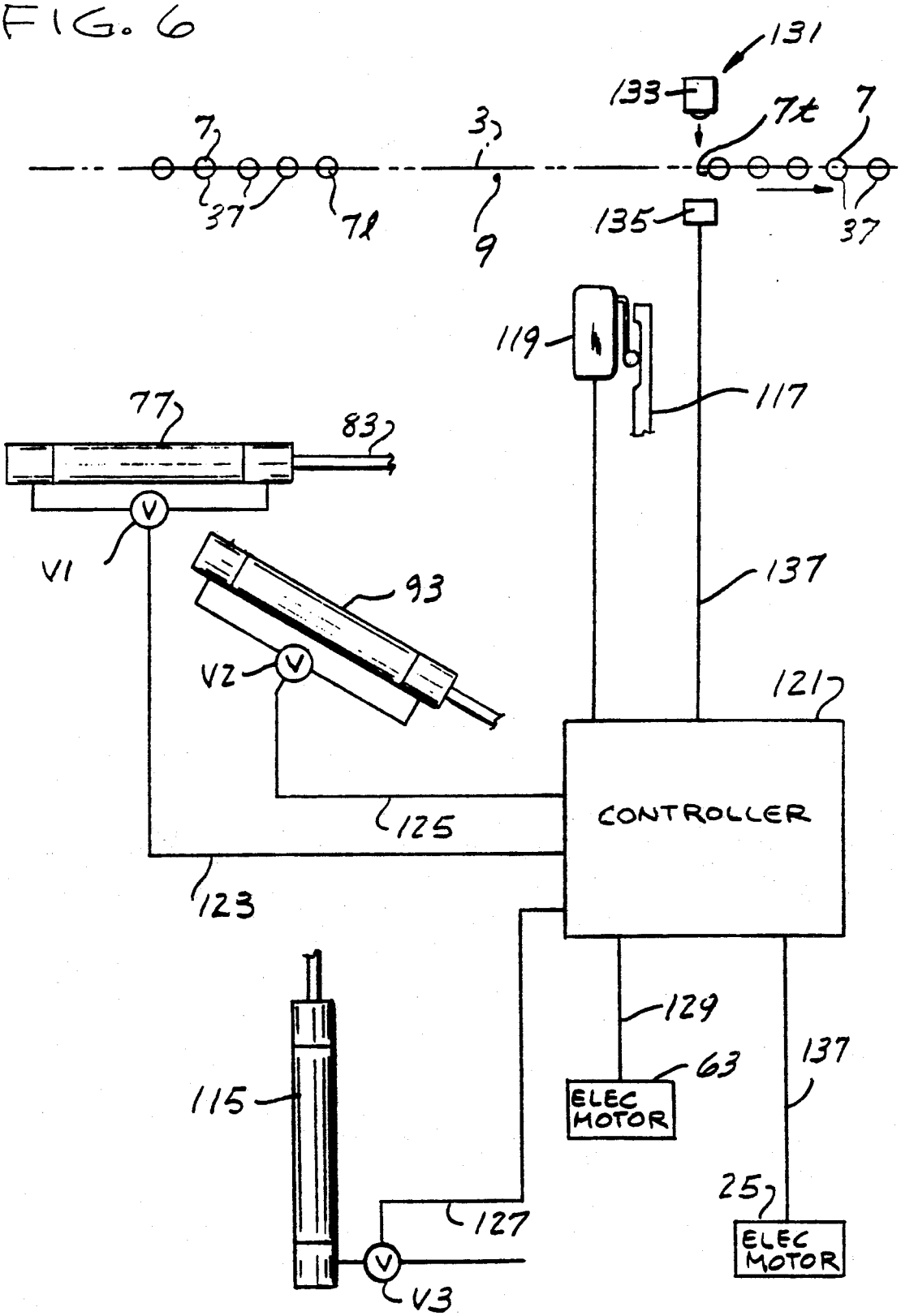

4 Claims, 6 Drawing Sheets